US007628310B2

(12) United States Patent
Perkins

(10) Patent No.: US 7,628,310 B2
(45) Date of Patent: Dec. 8, 2009

(54) INTERLOCKING CONTAINER

(75) Inventor: David W. Perkins, Hiawatha, IA (US)

(73) Assignee: Paper Systems, Inc., Des Moines, IA (US)

( * ) Notice: Subject to any disclaimer, the term of this patent is extended or adjusted under 35 U.S.C. 154(b) by 415 days.

(21) Appl. No.: 10/891,171

(22) Filed: Jul. 14, 2004

(65) Prior Publication Data

US 2004/0251300 A1 Dec. 16, 2004

Related U.S. Application Data

(62) Division of application No. 10/273,032, filed on Oct. 16, 2002, now Pat. No. 6,834,792.

(51) Int. Cl.
*B65D 5/10* (2006.01)

(52) U.S. Cl. ..... 229/109; 206/600; 229/117.3; 229/158; 229/199

(58) Field of Classification Search ..... 229/109, 229/117.3, 155, 158, 185, 198.2, 199; 220/7, 220/833, 835; 206/386, 600
See application file for complete search history.

(56) References Cited

U.S. PATENT DOCUMENTS 896,600 A * 8/1908 Thornton ..... 229/122.27
1,401,549 A * 12/1921 Nordstrom ..... 229/104
2,279,233 A * 4/1942 Groves ..... 229/125.39
2,562,261 A * 7/1951 Collins ..... 229/103.3
2,688,431 A * 9/1954 Loeb et al. ..... 206/423
3,132,791 A * 5/1964 Haysler et al. ..... 47/66.4
3,206,099 A * 9/1965 Fanter et al. ..... 229/155
3,219,255 A * 11/1965 Holmes ..... 229/154
3,949,874 A * 4/1976 Heavner ..... 206/596
4,226,327 A * 10/1980 Ballard ..... 206/320
4,383,609 A * 5/1983 Lochmiller ..... 206/386
4,392,606 A * 7/1983 Fremion ..... 206/600
4,392,607 A * 7/1983 Perkins, Jr. ..... 229/109
4,585,143 A * 4/1986 Fremow et al. ..... 206/386
4,606,461 A * 8/1986 Bolton, Sr. ..... 206/600
4,702,408 A * 10/1987 Powlenko ..... 229/101
4,708,260 A * 11/1987 Siegal et al. ..... 141/351
4,815,631 A * 3/1989 Eeg et al. ..... 229/117.3
4,880,141 A * 11/1989 Gossler et al. ..... 206/600
4,949,898 A * 8/1990 Nederveld ..... 229/117.02
5,139,196 A * 8/1992 Fry et al. ..... 229/157
5,145,110 A * 9/1992 Terpstra ..... 229/155
5,215,248 A * 6/1993 Moser ..... 229/122.21
5,305,950 A * 4/1994 Oppenheim ..... 229/157
5,501,395 A * 3/1996 McElroy ..... 229/148
5,549,341 A * 8/1996 Chase et al. ..... 294/68.1
5,573,175 A * 11/1996 Straub et al. ..... 229/109
5,746,343 A * 5/1998 Waltke et al. ..... 220/9.4
5,934,474 A * 8/1999 Renninger et al. ..... 206/600

(Continued)

*Primary Examiner*—Gary E Elkins
(74) *Attorney, Agent, or Firm*—Brett Trout

(57) ABSTRACT

A lightweight, collapsible container is provided for storing and transporting flowable materials on an irregularly shaped rectangular pallet. The container is provided with interlocking panels across the bottom, which are maintained in position by hydrostatic pressure generated by flowable material positioned within a flexible bag provided within the container. The top of the container is allowed to orient into its hydrostatically biased equilateral orientation, and provided with an equilateral octangular lid. This construction maintains the container bottom width substantially less than its length, with a minimum of support structures and materials.

9 Claims, 3 Drawing Sheets

U.S. PATENT DOCUMENTS 5,941,452 A * 8/1999 Williams et al. ..... 229/109
5,944,252 A * 8/1999 Connelly et al. ..... 229/132
6,000,549 A * 12/1999 Perkins ..... 206/596
6,029,884 A * 2/2000 Roeland ..... 229/125.19
6,050,410 A * 4/2000 Quirion ..... 206/386
6,074,331 A * 6/2000 Ruggiere et al. ..... 493/89
6,431,435 B1 * 8/2002 Jones et al. ..... 229/117.28
6,561,413 B2 * 5/2003 Colby ..... 229/190
6,834,792 B1 * 12/2004 Perkins ..... 229/109
2002/0158114 A1 * 10/2002 Evans et al. ..... 229/109

* cited by examiner 20
14
22
24
26
28
30
32
34
36
38
40
42
44
45
43
47
48
50
52
54
56
58
60
62
63
65
67
70
71
72
73
74
75
76
78
80
82
84
85
87
89
100
101

INTERLOCKING CONTAINER

This application is a divisional of Ser. No. 10/273,032 filed on Oct. 16, 2002 now U.S. Pat. No. 6,834,792.

BACKGROUND OF THE INVENTION

1. Field of the Invention

The present invention relates to bulk containers for flowable materials and, more specifically, to a bulk container having an irregular, octagonal bottom.

2. Description of the Prior Art

It is known in the art to provide rigid containers, such as drums, for the storage and transportation of flowable or fluid materials. Such prior art drums, however, are bulky and heavy, even when not in use. Also, by utilizing the strength attributes of the circular exterior, such drums do not maximize space efficiently, especially in association with rectangular pallets. Accordingly, when such drums are placed on a pallet, there are substantial open spaces, which could be better utilized to store and transport flowable materials.

It is also known in the art to reduce weight by providing a container of a flexible, circular construction, which may be collapsed for transportation and storage after use. While such containers utilize space somewhat more efficiently than drums, are somewhat lighter than drums, and may be reduced in size for storage, such containers still do not maximize the available space for storage of flowable materials. The flowable materials positioned within such a container produce large hydrostatic forces which bias the container toward a circular orientation. These hydrostatic forces prevent circular or equilateral octagonal containers from maximizing available space on pallets having a width less than a length. Although such containers can be reinforced with steel or similarly rigid materials to bias them toward an irregular orientation, such reinforcement increases weight, cost and maintenance associated with the containers, as well as increasing assembly and disassembly time.

While it is known in the art to provide rigid, square containers, maximizing the space allocation on both square and rectangular pallets, such containers are typically heavy, expensive and difficult to collapse for storage or transportation when not in use. Such containers also typically require supplemental tools and binding material for their assembly, as well as the additional time associated therewith.

It would, therefore, be desirable to provide a lightweight, foldable container for flowable materials which may be easily and quickly assembled, and which may be utilized to increase space utilization on a pallet having a width less than a length. The difficulties encountered in the prior art described hereinabove are substantially eliminated by the present invention.

SUMMARY OF THE INVENTION

It is an object of the present invention to provide a flowable materials container which is low cost.

It is another object of the present invention to provide a flowable materials container which is lightweight.

It is still another object of the present invention to provide a flowable materials container which may be folded flat for transport.

It is yet another object of the present invention to provide a flowable materials container which efficiently utilizes space on a pallet having a width less than a length.

It is another object of the present invention to provide a flowable materials container which may be utilized in association with standard pallets.

The present invention relates to a collapsible container having four, but preferably eight sides, with two facing sides having depending tabs with male and female members for mating engagement. The sides defining the perpendicular direction are also provided with extending tabs having male and female members for mating engagement. The male and female members are designed to maintain the side panels at a predetermined distance, which, in the preferred embodiment, is designed with one distance being greater than another to maximize space utilization on a pallet having a width less than a length. Preferably the side panels and tabs are constructed of cardboard into an irregular octagon, defining an interior. A flexible bag is placed within the interior and filled with a flowable material. The hydrostatic forces associated with the flowable material push downward on the interlocking mating members to prevent their inadvertent dislodgement, and prevent the footprint of the container from extending beyond the edges of the pallet.

DETAILED DESCRIPTION OF THE PREFERRED EMBODIMENT

Figure 1:
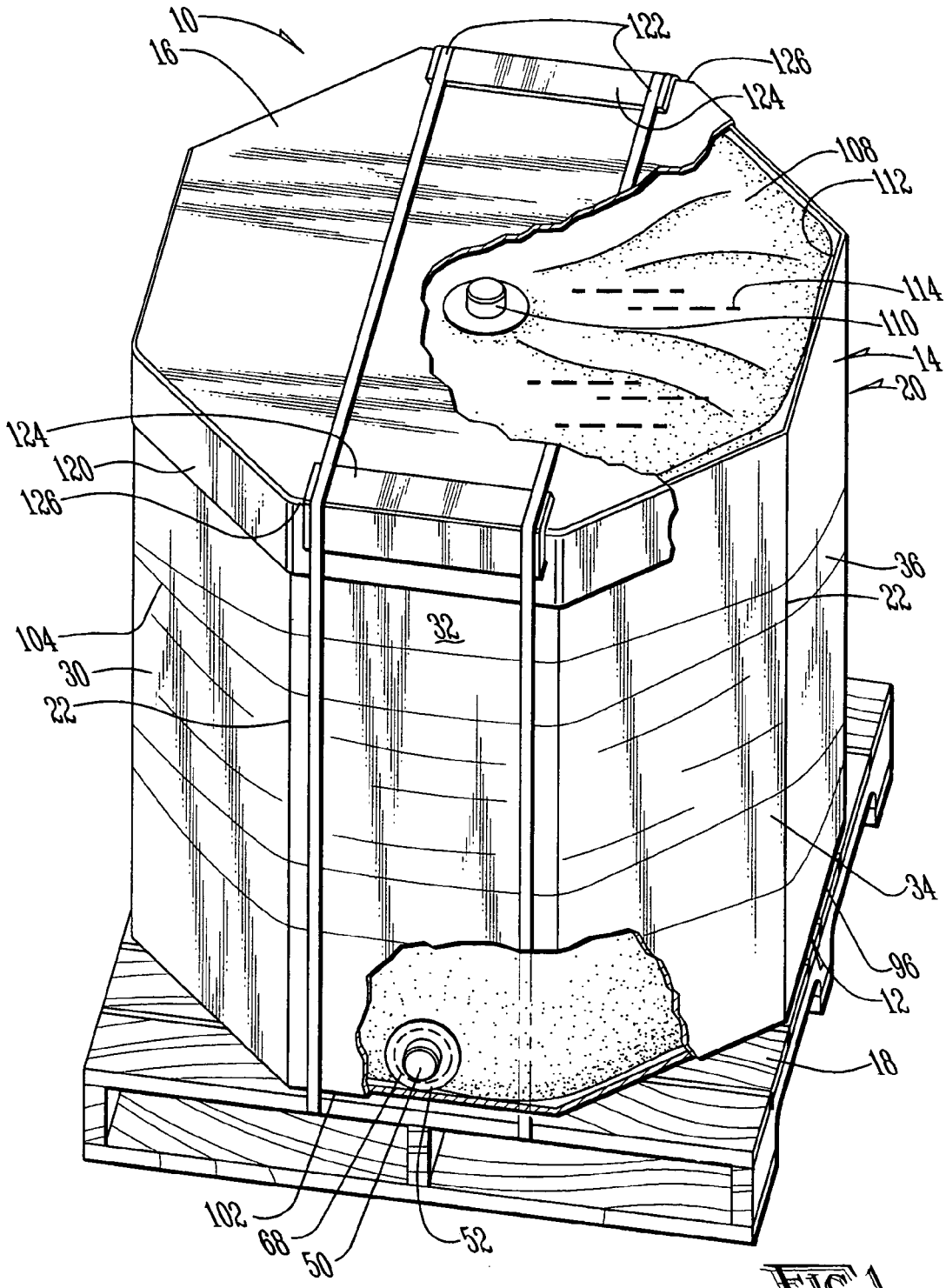
FIG. 1 illustrates a side perspective elevation in partial cutaway of the irregular container of the present invention, shown positioned on a pallet, assembled and containing a flowable material.

A collapsible container for containing flowable materials is shown generally as (10) in FIG. 1. As shown, the container (10) includes a bottom (12), a plurality of side panels (14) and a lid (16). Although the container (10) may be designed of any suitable dimensions, in the preferred embodiment the bottom (12) is dimensioned to fit on a substantial standard 48" long and 40" wide stringer pallet (18).

Figure 2:
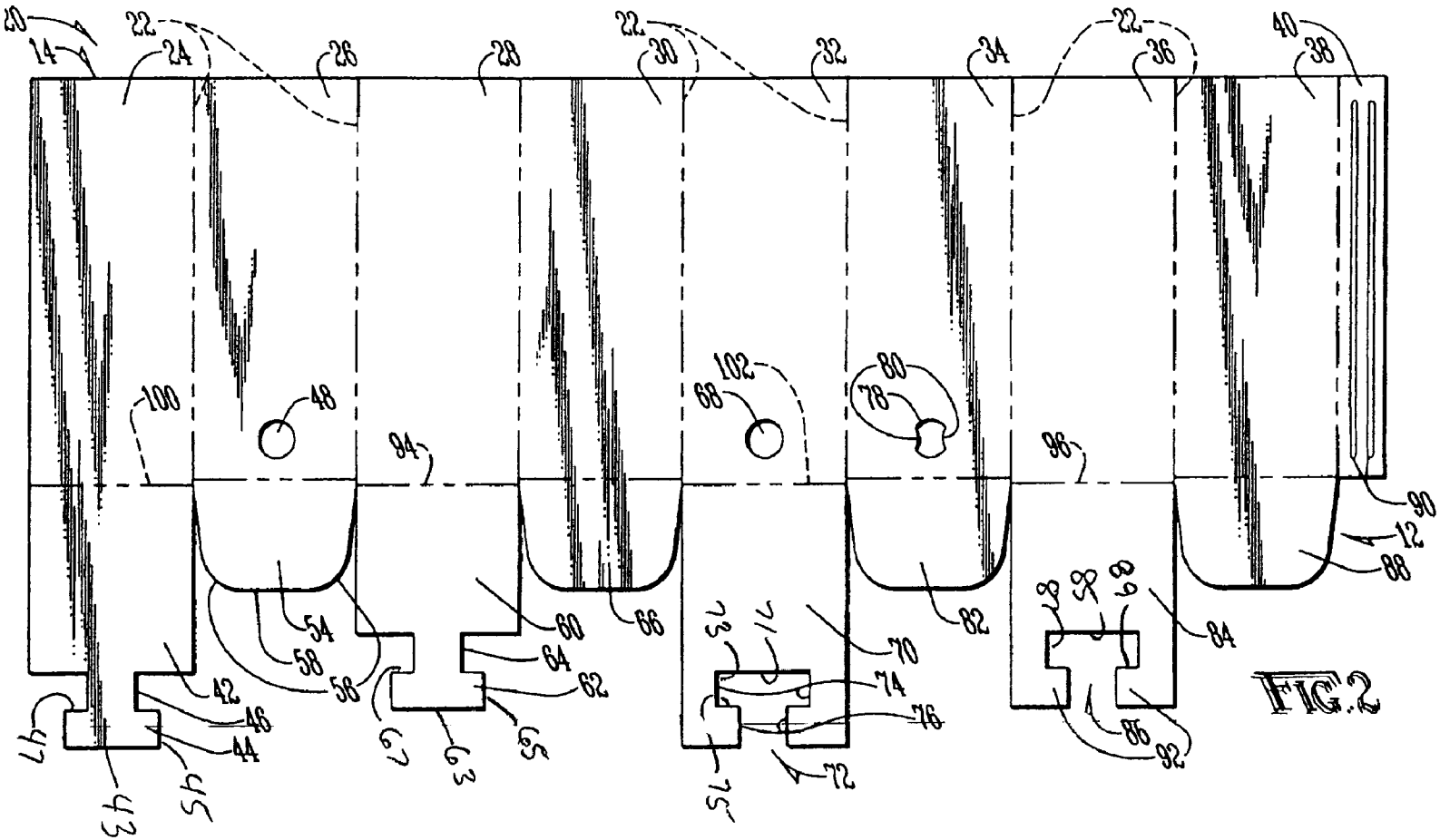
FIG. 2 illustrates a side elevation showing the sides and bottom of the container of FIG. 1 prior to assembly.

Preferably, the bottom (12) and side panels (14) of the container are constructed of a single sheet of triple sided corrugated cardboard, such as that known in the art. As shown in FIG. 2, a long sheet (20) of such cardboard is die cut in the configuration shown and provided with a plurality of creases (22) to create the side panels (14) and bottom (12). The creases (22) divide the sheet (20) into a first panel (24), a second panel (26), a third panel (28), a fourth panel (30), a fifth panel (32), a sixth panel (34), a seventh panel (36), an eighth panel (38), and an overhang (40). Preferably, the first eight side panels (14) are 17⅜ inches in width, while the overhang (40) is 5¼ inches wide. Provided on the first panel (24) is a first male tab (42). The side panels (14)) are preferably 41.5 inches in length. The first male tab (42) is preferably 27.4375 inches in length. The end of the first male tab (42) is fashioned into the shape of a first male member (44). The first male member is preferably 10.3125 inches wide and 3.75 inches long. The first male member (44) is also provided with a first male neck (46), preferably 5.5625 inches wide and 3.75 inches long.

The second panel (26) is preferably provided with a first cutout (48) for the provision of a nozzle (50), such as that shown in FIG. 1. The first cutout (48) is preferably of a diameter greater than the nozzle (50) but less than a collar (52) secured to the nozzle (50) to prevent the nozzle (50) from passing completely through the first cutout (48). In the preferred embodiment, the first cutout (48) is preferably provided with a diameter of 3.625 inches. Secured to the second panel (26) is a first cover flap (54). As shown in FIG. 2, the first cover flap (54) is preferably 11.75 inches long and 17.375 inches wide at its base to match the width of the panels (24-38). As shown, the sides (56) of the first cover flap (54) taper inward slightly and round toward a flat-edged end (58).

Coupled to the third panel (28) is a second male tab (60) having a second male member (62) and a second male neck (64). Although the second male member (62) and second male neck (64) are of dimensions similar to those noted above in association with the first male member (44) and first male neck (46), the overall length of the second male tab (60) is only 23.3125 inches. Coupled to the fourth panel (30) is a second cover flap (66) of a design and having dimensions similar to those noted above in association with the first cover flap (54).

The fifth panel (32) is provided with a second cutout (68), having dimensions similar to the first cutout (48). Coupled to the fifth panel (32) is a first female tab (70). The first female tab is preferably 27.4375 inches long and 17.375 inches wide. The first female tab (70) is preferably provided with a first female cutout (72). The first female cutout (72) is preferably provided with a body cutout 10.25 inches wide and 3.75 inches long, and a neck cutout 5.5 inches wide and 3.75 inches long.

The sixth panel (34) is provided with a third cutout (78) having a diameter of 3.625 inches, but being provided with a pair of arcuate ears (80) which act to retain the nozzle (50) in place, and prevent the nozzle (50) from retracting back into an interior of the container (10). (FIGS. 1-2). The sixth panel is coupled to a third cover flap (82) of dimensions similar to those noted above in association with the first cover flap (54).

The seventh panel (36) is provided with a second female tab (84), having a second female cutout (86), having dimensions similar to those noted above in association with the first female cutout (72). The second female cutout (86), however, is only 23.3125 inches in length.

The eighth panel (38) is provided with the fourth cover flap (88) of dimensions similar to those noted above in association with the first cover flap (54). Provided on the side of the eighth panel (38) is the overhang (40), which is preferably, like the panels themselves, 40.875 inches long. The overhang (40), however, is preferably only 5.25 inches wide.

To construct the container (10), beads of glue (90) are applied to the overhang (40) and pressed between the overhang (40) and the first panel (24), preferably causing the overhang (40) to be located in an interior defined by the side panels (14). Gluing the overhang (40) to the first panel (24) defines a generally octagonal tube. The cover flaps (54), (66), (82) and (88) are bent inward into the interior defined by the side panels (14). Thereafter, the second male tab (60) and second female tab (84) are bent toward one another sufficiently to allow the second male member (62) to be inserted into the second female cutout (86) defined by the second female tab (84).

Preferably, the second female tab (84) is provided with a plurality of small ears (92) of cardboard which extend into the second female cutout (86) to engage the second male member (62) and prevent its undesired dislodgement from the second female cutout (86). As noted above, the second male member (62) is slightly wider than the width of the second female cutout (86), thereby assuring a snug fit of the second male member (62) into mating engagement with the second female cutout (86) of the second female tab (84). When secured into such mating engagement, the second male tab (60) and second female tab (84) define a distance between a bottom (94) of the third panel (28) and a bottom (96) of the seventh panel (36) of 39.125 inches, allowing for the thickness of the corrugated cardboard construction of the container (10), the resulting width allows the container to be positioned upon a 40 inch wide pallet (18).

In a similar manner, the first male tab (42) and first female tab (70) are bent inward into mating engagement as described above. The second female tab (70) is also provided with a plurality of ears to secure the first male member (44) within the first female cutout (72) of the first female tab (70). Due to the extended length of the first male tab (42) and first female tab (70), the mating engagement of the tabs (42) and (70) positions the bottom (100) of the first panel (24) and the bottom (102) of the fifth panel (32) 47.375 inches apart. These dimensions allow the container (10) to fit on a typical 48 inche by 40 inch pallet.

Figure 3:
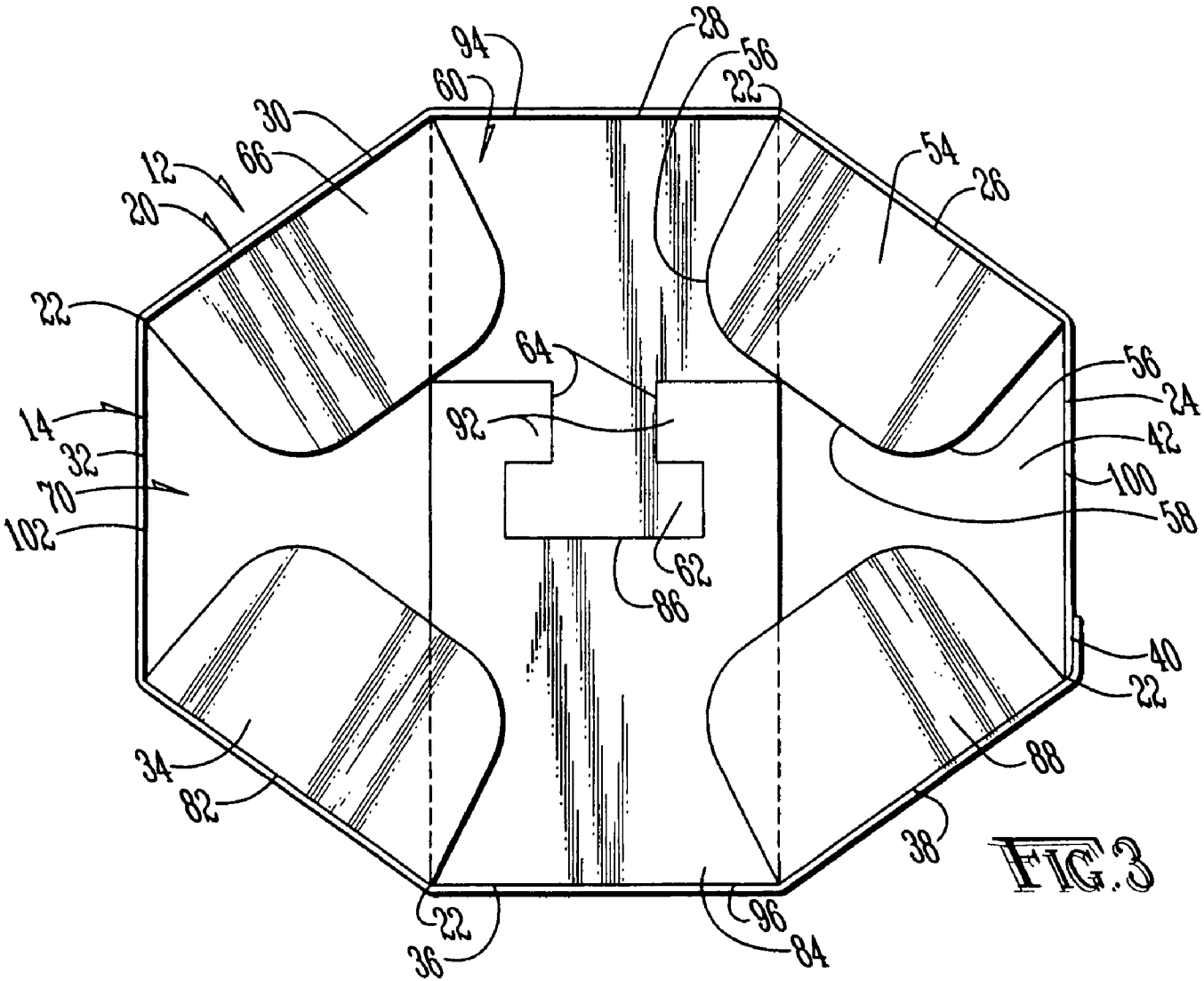
FIG. 3 illustrates a top plan view of the bottom of the container after assembly.

Once the container (10) has been constructed as described above, as shown in FIG. 3, the cover flaps (54), (66), (82) and (88) rest over the male and female tabs (42), (60), (70) and (84). Once the container (10) has been constructed in this manner, the container (10) is wrapped with a low density polyethylene wrap (104), or the like, to add tensile strength to the container (10). Once the container has been wrapped, a removable, flexible liner (108), preferably constructed of polyethylene, such as that well known in the art to hold non-hazardous fluid material, is positioned within the container (10). Preferably, the liner (108) is provided with the nozzle (50), which is extended through the second cutout (68) provided on the fifth panel (32). As noted above, the collar (52) of the nozzle (50) prevents the entire assembly from passing out through the second cutout (68). The liner (108) is also preferably provided with a top cap (110). The container (10) is constructed with a large opening (112) which allows a very large fill head (not shown) to enter the container (10) and couple to the top cap (110) to fill the flexible liner (108).

As the flexible liner (108) fills with flowable material (114) such as fruit juice concentrate, tomato paste or the like, hydrostatic pressure forces the liner (108) against the sidewalls (24-38) and downward against the tabs and flaps (42), (54), (60), (66), (70), (82), (84) and (88). This hydrostatic pressure presses firmly against the bottom (12) of the container (10) to prevent the male members (44) and (62) from becoming dislodged from the female cutouts (72) and (86). The more flowable material (114) added to the liner (108), the greater the pressure on the bottom (12) of the container (10) and the less likely it is that the bottom (12) will become unhinged. The securement of the bottom (12) is important, as the hydrostatic forces bias the container (10) toward a circular, or right octangular, orientation. As the top (116) of the container (10) is not constrained by mating engagement of male and female tabs, hydrostatic forces bias the lid (16) toward a right octangular orientation. However, as the bottom (12) remains constrained, the entire container (10) is still capable of being positioned on a 40 inch by 48 inch pallet.

As shown in FIG. 1, once the liner (108) has been filed with flowable material (114), the top cap (110) is closed and the lid (16) is provided over the side panels (14). Although the lid (16) may be of any desired construction, in the preferred embodiment, the lid (16) is simply a piece of corrugated cardboard provided with a top (118), hingably and integrally coupled to a plurality of sidewalls (120), which simply overlap one another when the lid (16) is positioned over the side panels (14). Preferably, as hydrostatic forces force the tops of the side panels (14) toward a right octangular orientation, the lid (16) is provided with a right octangular construction, having an interior distance of 44 inches spanning flat side to flat side.

Although the sidewalls (120) of the lid (16) may be fastened together or interlocked to one another, the lid (16) is preferably secured to the side panels (14) by steel bands (122), such as those well known in the art for lashing material to pallets. The use of the steel bands (122) maintains the lid (16) secured to the side panels (14) and eliminates the need for strong securement of the sidewalls (120) of the lid (16) to one another. Preferably, as shown in FIG. 1, a pair of rectangular pieces of cardboard (124) are laid over the lid (16) at the points where the steel bands (122) cover the edges (126) of the lid (16). This reduces damage to the lid (16) from the steel bands (122), and reduces the incidence of rupture as the result of back and force sawing motion of the steel bands (122) against the lid (16).

The foregoing description and drawings merely explain and illustrate the invention, and the invention is not limited thereto, except insofar as the claims are so limited, as those skilled in the art who have the disclosure before them will be able to make modifications and variations therein without departing from the scope of the invention. By way of example, although assemblies is described herein are preferably constructed within about one-hundred percent variance, and more preferably within ten percent variance, from the dimensions listed above, the container (10) may be constructed of any desired material, in any suitable dimensions, and may be provided with any desired number of sides. Additionally, the container (10) may be of any desired construction and coupled together by any desired means.

What is claimed is:

1. A collapsible container comprising:

(a) a first side panel;

(b) a second side panel;

(c) a third side panel;

(d) a fourth side panel;

(e) a first catch coupled to said first side panel, said first catch comprising:

(i) a first forward exterior perimeter face;

(ii) a first lateral exterior perimeter face; and (iii) a first rearward exterior perimeter face;

(f) A first keeper coupled to said second side panel, said first keeper comprising:

(i) a first forward interior perimeter face;

(ii) a first lateral interior perimeter face; and (iii) a first rearward interior perimeter face;

(g) wherein said first forward exterior perimeter face of said first catch is engaged with said first rearward interior perimeter face of said first keeper;

(h) wherein said first lateral exterior perimeter face of said first catch is provided adjacent said first lateral interior perimeter face of said first keeper;

(i) wherein said first rearward exterior perimeter face of said first catch is engaged with said first forward interior perimeter face of said first keeper;

(j) a second catch coupled to said third side panel, said second catch comprising:

(i) a second forward exterior perimeter face;

(ii) a second lateral exterior perimeter face; and (iii) a second rearward exterior perimeter face;

(k) a second keeper coupled to said fourth side panel, said second keeper comprising:

(i) a second forward interior perimeter face;

(ii) a second lateral interior perimeter face; and (iii) a second rearward interior perimeter face;

(l) wherein said second forward exterior perimeter face of said second catch is engaged with said second rearward interior perimeter face of said second keeper;

(m) wherein said second lateral exterior perimeter face of said second catch is provided adjacent said second lateral interior perimeter face of said second keeper;

(n) wherein said second rearward exterior perimeter face of said second catch is engaged with said second forward interior perimeter face of said second keeper.

2. The collapsible container of claim 1, further comprising a lid provided over an interior defined by said first side panel, said second side panel, said third side panel, and said fourth side panel.

3. The collapsible container of claim 2, wherein said lid forms a substantially equilateral octagon.

4. The collapsible container of claim 1, further comprising a flexible bag provided within an interior defined by said first panel, said second panel, said third panel and said fourth panel.

5. The collapsible container of claim 1, wherein said first side panel defines a hole.

6. The collapsible container of claim 5, further comprising a fluid nozzle provided through said hole.

7. The collapsible container of claim 6, further comprising a flexible bag provided within an interior defined by said first side panel, said second side panel said third side panel, and said fourth side panel.

8. The collapsible container of claim 1, further comprising a flexible reinforcing material provided around said first side panel, said second side panel, said third side panel, and said fourth side panel.

9. The collapsible container of claim 8, wherein said reinforcing material is a film no greater than 2 millimeters thick.

* * * * *